US005352033A

United States Patent [19]

Gresham et al.

[11] Patent Number: 5,352,033

[45] Date of Patent: Oct. 4, 1994

[54] OPERATOR WORK STATION HAVING A MONITOR SUPPORT ASSEMBLY

[75] Inventors: David Gresham, Columbus, Ohio; Michael J. Kurimski, Georgetown, Tex.; Matthew D. Hern, Columbus, Ohio; Piero Molteni, Di Modrone; Arch Franco L. Grampella, Milan, both of Italy

[73] Assignee: Fisher-Rosemount Systems, Inc., Austin, Tex.

[21] Appl. No.: 956,748

[22] Filed: Oct. 5, 1992

Related U.S. Application Data

[63] Continuation-in-part of Ser. No. 859,021, Mar. 27, 1992, Pat. No. 5,265,952.

[51] Int. Cl.[5] ..... A47B 51/00

[52] U.S. Cl. ..... 312/312; 108/147; 108/50

[58] Field of Search ..... 312/7.2, 223.3, 312, 312/319.6, 319.8, 247, 242, 201, 107; 108/147, 50, 64; 52/36, 29, 31, 32, 65

[56] References Cited

U.S. PATENT DOCUMENTS

| | | | |
|---|---|---|---|
| D. 134,727 | 5/1942 | Weber . | |
| D. 151,111 | 8/1946 | Westlake . | |
| 3,291,432 | 12/1966 | Lucasey . | |
| 3,662,981 | 5/1972 | Hogrebe . | |
| 3,869,992 | 3/1975 | Kramer . | |
| 4,025,017 | 5/1977 | Miller . | |
| 4,274,685 | 6/1981 | Bradshaw | 312/7.2 |
| 4,447,031 | 5/1984 | Souder, Jr. et al. . | |
| 4,487,389 | 12/1984 | Ziegler . | |
| 4,516,751 | 5/1985 | Westbrook . | |
| 4,657,316 | 4/1987 | Hardt et al. . | |
| 4,836,478 | 6/1989 | Sweere . | |
| 4,852,500 | 8/1989 | Ryburg et al. . | |
| 4,964,606 | 10/1990 | Beam et al. . | |
| 5,007,608 | 4/1991 | Carroll, Jr. . | |
| 5,020,752 | 6/1991 | Rizzi et al. . | |
| 5,101,736 | 4/1992 | Bommarito et al. . | |
| 5,103,741 | 4/1992 | Grund et al. . | |
| 5,181,771 | 1/1993 | Robak et al. | 312/7.2 |
| 5,265,952 | 11/1993 | Gresham et al. | 312/312 |

FOREIGN PATENT DOCUMENTS

| | | | |
|---|---|---|---|
| 0145410 | 11/1984 | European Pat. Off. . | |
| 0160869 | 11/1985 | European Pat. Off. | 312/223.3 |
| 3427229 | 1/1986 | Fed. Rep. of Germany | 312/223.3 |
| 3506381 | 8/1986 | Fed. Rep. of Germany | 312/223.3 |

*Primary Examiner*—Peter R. Brown
*Assistant Examiner*—Janet M. Long
*Attorney, Agent, or Firm*—Haynes and Boone

[57] ABSTRACT

An operator work station defined by a wall having a support assembly for mounting a monitor within a housing within an opening in the wall, the support assembly enabling the monitor to have four degrees of freedom. The support assembly includes a counterbalanced horizontal bar slidably disposed in the opening parallel to the wall for enabling the monitor to be raised and lowered parallel to the wall. Bearings rigidly secured to the bar receive rods rigidly secured to a horizontal plate, the movement of which enables the monitor to be moved perpendicular to the wall. A shaped plate pivotally connected between the horizontal plate and the housing enables the monitor to rotate about a vertical axis. Such rotation is limited by posts rigidly secured to the bar which engage the sides of the shaped plate when the shaped plate is rotated with respect to the wall. A shutter pivotally mounted within the housing for rotation around a horizontal axis has upper and lower arc-shaped panels which frictionally engage the upper and lower plates of the housing to enable the monitor to rotate around the horizontal axis to adjust the tilt of the monitor.

37 Claims, 6 Drawing Sheets

OPERATOR WORK STATION HAVING A MONITOR SUPPORT ASSEMBLY

CROSS-REFERENCE TO RELATED APPLICATION

This application is a continuation-in-part of patent application Ser. No. 07/859,021 filed Mar. 27, 1992, now U.S. Pat. No. 5,265,952.

BACKGROUND OF THE INVENTION

This invention relates to a work station and, more particularly, to a work station which provides an operator with a comfortable work environment while providing viewing access to a video monitor mounted in a wall of the work station, which mounting mechanism affords the monitor up to four degrees of freedom to meet the ergonomic needs of the operator.

As the use of computers and computer monitors increases, it becomes increasingly necessary to provide the operators with private or semi-private work stations in which the operators are provided with a desk and a monitor used alone or in conjunction with a computer.

These types of work stations often involve modular units in order to locate as many operators as possible in a given office space to maximize space usage. However, with operators spending more and more time at work stations of the above type, their comfort is compromised due to inadequate ergonomics. For example, when a computer monitor is involved in the work station, most modular work station designs position the monitor on the operator's work surface, in direct alignment with the operator. However, when the operator wishes to engage in activities other than monitor viewing such as paper work, reading, etc., the space available for these activities is often inadequate. In addition, since the monitor is placed on the operator's work surface, he must usually tilt the screen upwardly for improving his viewing alignment, but upwardly tilting the screen causes glare from overhead lighting.

Moreover, current work station designs do not address the problems caused by variations in the individuals who are to use the work station. Specifically, the most effective orientation of a monitor varies with each individual's height, the height of his chair, his vision, etc., but current designs do not provide sufficient and easy realignment of equipment.

Other problems with conventional modular work stations are that they often cannot accommodate additional personnel, are not flexible enough to adapt to different environments and do not present a finished, professional appearance. Further, these conventional work stations are not designed to cover or house the clutter caused by the wiring and cables required for the computer, the monitor and other associated electronic equipment.

SUMMARY OF THE INVENTION

It is therefore an object of the present invention to provide a work station which provides the operator a private or semi-private area which is maximized for ergonomics yet takes up a relative small amount of space.

It is a further object of the present invention to provide a work station of the above type in which adequate work surface area is provided while still permitting viewing of a computer monitor from an optimum distance.

It is a further object of the present invention to provide a work station of the above type which accommodates a plurality of operators having access to continuous work surfaces and monitors.

It is a further object of the present invention to provide a work station of the above type in which multiple operators can be provided in the area of two connecting perpendicular walls.

It is a further object to provide a work station of the above type which can be adapted to different desk and wall arrangements and yet gives a finished appearance.

It is a further object to provide a work station of the above type which provides for maximum comfort of the operator yet fosters team integration, communication and problem solving.

It is a further object to provide a work station of the above type which allows the monitor to be realigned and moved to meet the demands of different operators.

It is a further object to provide a work station of the above type which allows the monitor to have four degrees of freedom.

It is a further object to provide a work station of the above type in which monitor glare from overhead lighting can be reduced.

Toward the fulfillment of these and other objects, the work station of the present invention includes one or more work surface modules located adjacent a wall or walls and defining one or more continuous work surfaces along the wall(s). An opening is formed through one of the walls in a predetermined relationship with the work surface modules, and a housing for receiving a monitor is pivotally mounted for movement about a vertical axis relative to the opening to adjust the monitor relative to the work surface modules for viewing. The work surface modules can be configured to provide one or more continuous work surfaces along one wall or around a corner and along another wall.

In an alternative embodiment, the monitor is mounted in a support assembly contained within the wall which affords the monitor four degrees of freedom. The support assembly moves vertically to allow the operator to adjust the height of the monitor to a desired level. In addition, the support assembly is counterbalanced for easier height manipulation. Further, the support assembly includes a plate which horizontally slides within bearings to allow the operator's distance to the monitor to be adjusted. The support assembly also contains a pivot plate pivotally mounted to the monitor to allow the monitor to pivot about a vertical axis, the degree of such pivot controlled to prevent the monitor from striking the wall. Moreover, the monitor is mounted within a shutter pivotally mounted within the monitor housing about a horizontal axis which allows the tilt of the monitor to be adjusted.

BRIEF DESCRIPTION OF THE DRAWINGS

The above brief description, as well as further objects, features and advantages of the present invention will be more fully appreciated by reference to the following detailed description of the presently preferred but nonetheless illustrative embodiments in accordance with the present invention when taken in conjunction with the accompanying drawings wherein.

DESCRIPTION OF THE PREFERRED EMBODIMENT

Figure 1:
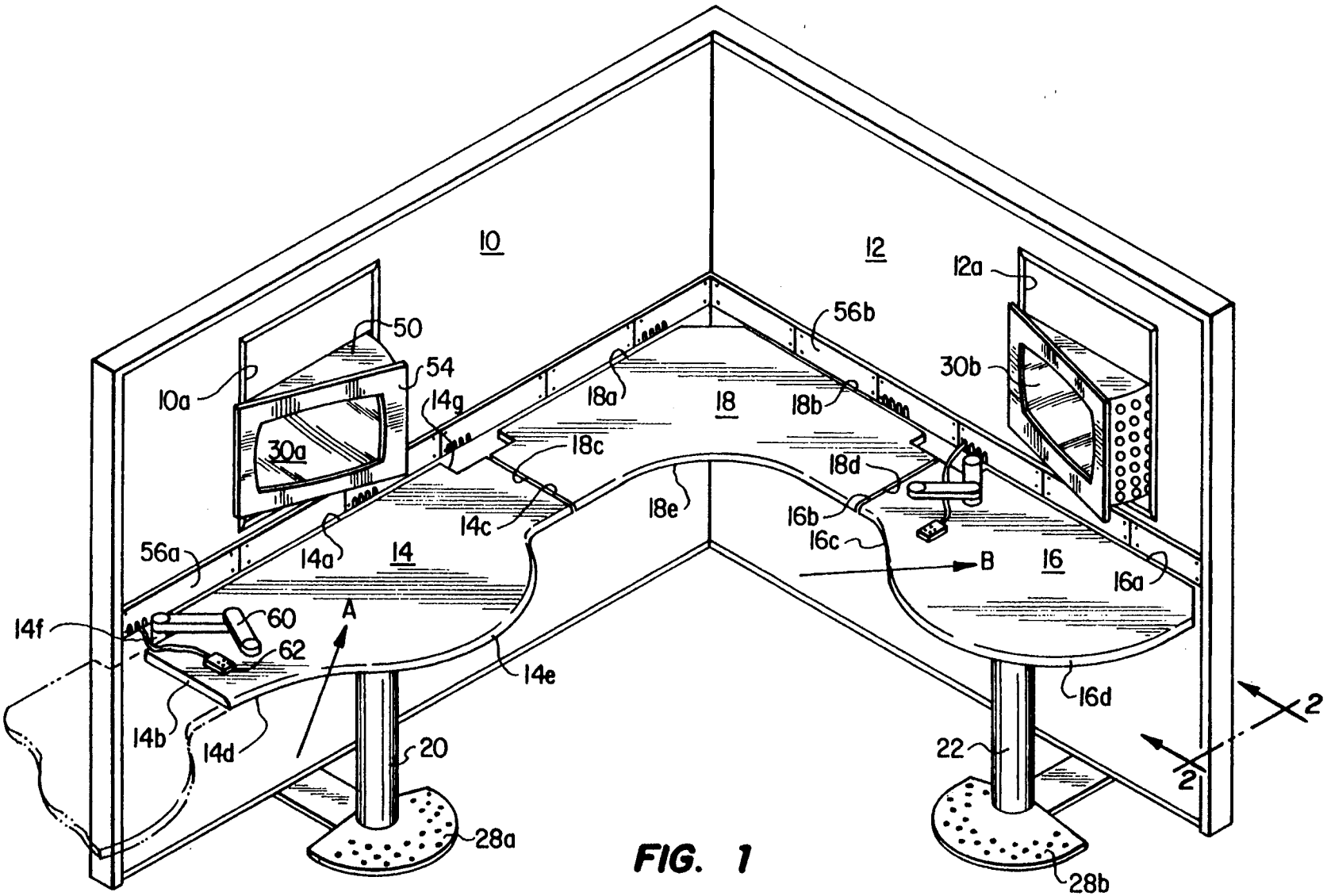
FIG. 1 is a perspective view of a work station of the present invention.

FIG. 1 of the drawings depicts an operator work station 8 embodying features of the present invention and including two perpendicular walls 10 and 12 extending from the floor of the building to the ceiling, or to a predetermined height below the height of the ceiling. The walls 10 and 12 can be permanently installed or can be "modular", i.e. free standing and quickly assembled and disassembled. In either case the walls 10 and 12 are hollow to enable them to contain internal components, as will be described.

For the purposes of example, the work station 8 includes three work surfaces, or desk modules, 14, 16 and 18 with the module 14 extending adjacent the wall 10, the module 16 extending adjacent the wall 12 and the module 18 extending adjacent the corner defined by both walls. The respective ends of the corner desk module 18 are located adjacent the corresponding ends of the desk module 14 and the desk module 16, respectively.

The desk module 14 has a straight side portion 14*a* facing the wall 10 and two straight end portions 14*b* and 14*c* extending perpendicular to the side portion 14*a*. The other side of the module 14 is irregular in shape and is formed by a relatively gradually curved portion 14*d* extending from the side portion 14*b*, and a relatively abruptly curved portion 14*e* extending from the curved portion 14*d* to the other end portion 14*c*. The transition from the gradually curved portion 14*d* to the abruptly curved portion 14*e* occurs approximately midway between the end portions 14*b* and 14*c*. As a result, the desk module 14 is of minimum width near its end portions 14*b* and 14*c* and of maximum width approximately midway between its end portions 14*b* and 14*c*.

The desk module 14 is designed for a right-handed operator who would normally sit adjacent the gradually curved portion 14*d* and face in a direction indicated by the arrow A. This enables the module 14 to be dimensioned so that the operator is located an optimum viewing distance from the monitor (discussed below) yet has ample leg room and writing surface due to the increased module width resulting from the curved portions 14*d* and 14*e*. It is understood that a desk module similar to the module 14 can be designed for a left-handed operator in which case it would be a mirror image of the module 14, and that a plurality of desk modules 14 can be connected in an end-to-end relationship along the wall 10 as shown by the phantom lines.

The desk module 16 is a "stand-alone" module and, as such, is designed to form the end module of a series of modules including the series shown in FIG. 1. The module 16 includes a straight side portion 16*a* facing the wall 12 and a straight end portion 16*b* extending perpendicularly to the side portion 16*a*. The other side of the module 16 includes a relatively gradually curved portion 16*c* extending from the side portion 16*a* and a relatively abruptly curved portion 16*d* extending from the curved portion 16*c*. The curved portion 16*d* is rounded off to also form the other end portion of the module 16 and thus gives a finished look. Therefore, the module 16 is not designed to be connected between other modules but can either stand alone or form the end module of a series. The module 16 is also designed for a right-handed operator who would sit adjacent the curved portion 16*c* and normally face in a direction indicated by the arrow B. A mirror image of the module 16 could also be placed along the wall 10 and adjacent the end 14*b* of the module 14 as could also be represented by the phantom lines in FIG. 1, or, if a plurality of modules 14 are located adjacent the wall 10, at the corresponding end of the endmost module 14.

The corner module 18 includes a back portion 18*a* facing the wall 10, a back portion 18*b* extending perpendicular to the back portion 18*a* and facing the wall 12, an end portion 18*c* extending perpendicular to the back portion 18*a*, an end portion 18*d* extending perpendicular to the back portion 18*b* and a concave curved portion 18*e* extending between the end portions 18*c* and 18*d*. The end portion 18*c* of the corner module 18 is disposed adjacent the end portion 14*c* of the module 14 and the end portion 18*d* is disposed adjacent the end portion 16*b* of the module 16. It is understood that one or more modules 14 can be placed between the modules 16 and 18 to form additional stations along the wall 12.

Figure 2:
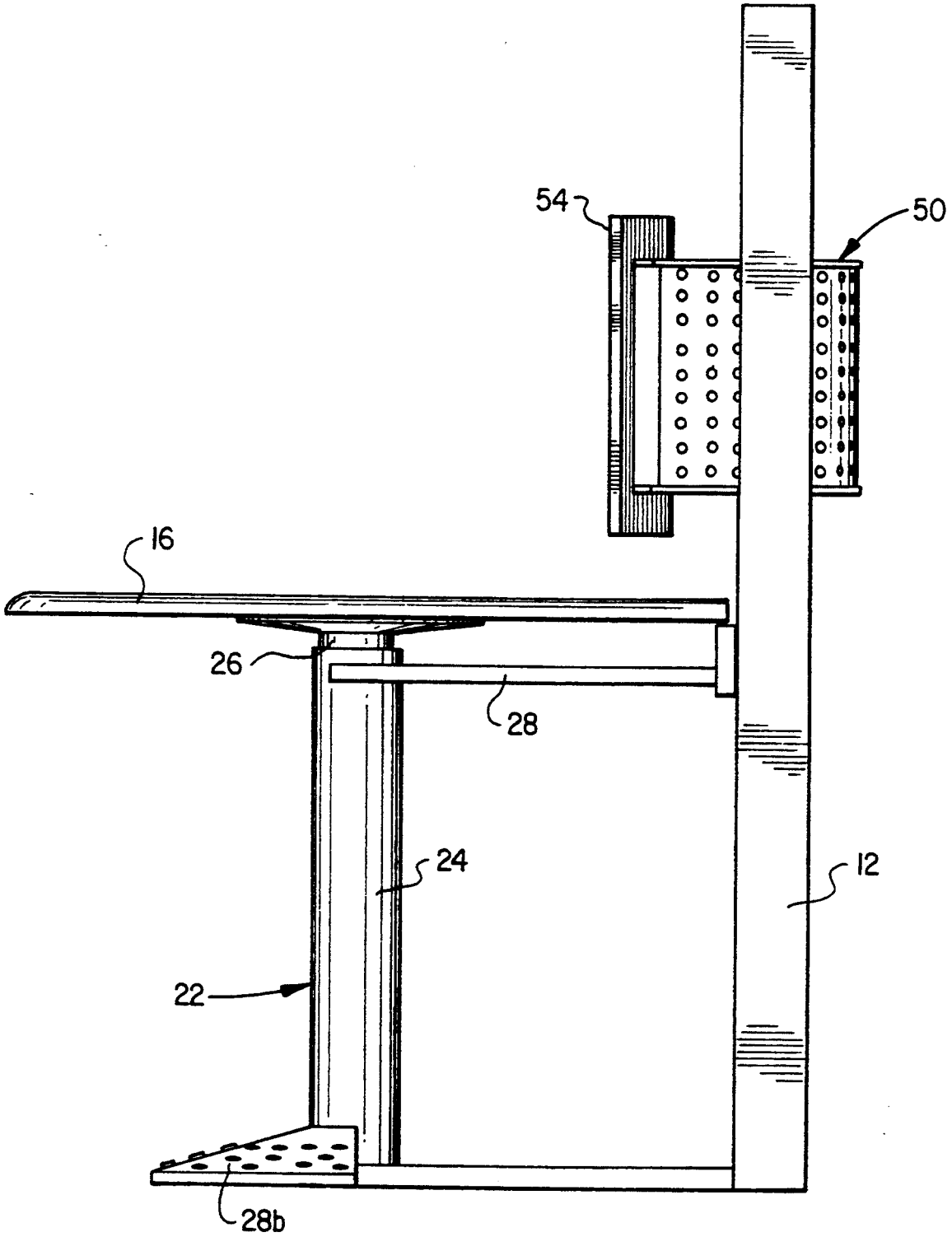
FIG. 2 is an enlarged view taken along the line 2—2 of FIG. 1.

Two pedestals 20 and 22 extend from the lower surfaces of the modules 14 and 16, respectively, and support the modules in an elevated position. The pedestal 22 is shown in detail in FIG. 2 and includes an outer cylinder 24 which contains either an electric motor or similar manual actuation device (not shown) and a piston 26 telescopicly mounted within the cylinder 24 for reciprocal movement in an axial direction in a conventional manner. The upper end of the piston 26 abuts against (and can be fastened to) the central portion of the lower surface of the desk module 16. A U-shaped bracket 28 (partially shown) extends around the upper end portion of the cylinder 24 and is fastened, in any conventional manner, to the wall 12. Thus, actuation of the motor can raise or lower the desk module 16. Since the pedestal 20 is identical to the pedestal 22 it will not be described in detail.

The pedestals 20 and 22 extend through bases 28*a* and 28*b*, respectively, which rest on the floor, provide support for the pedestals and cover the electrical wire and cables (not shown) extending from the pedestals.

It is understood that the corner module 18 is supported by brackets, or the like (not shown) affixed to the walls 10 and 12. Alternatively, the module 18 could be supported by a pedestal identical to the pedestals 20 and 22.

Figure 3:
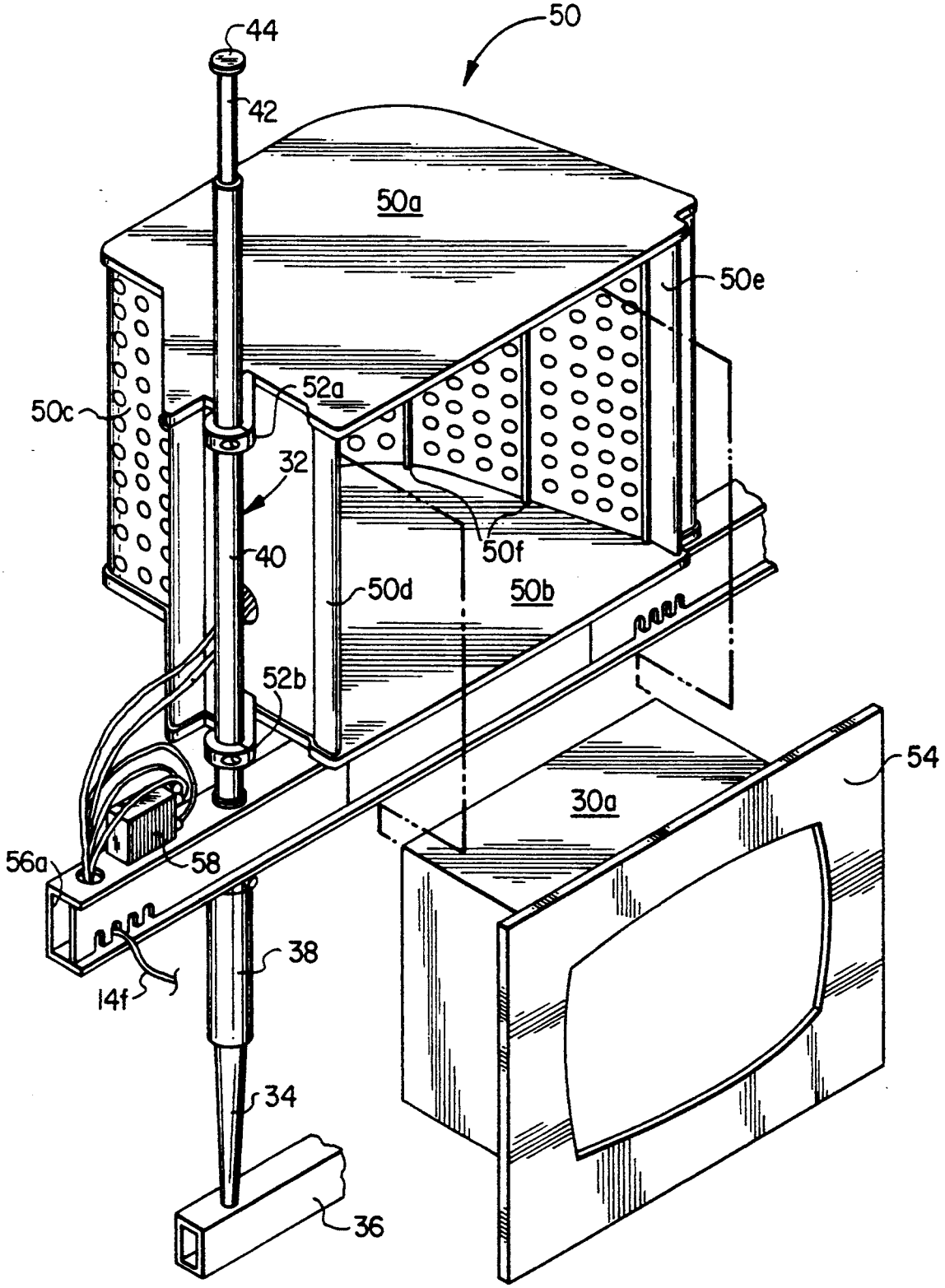
FIG. 3 is an enlarged, partially broken-away view of the monitor support assembly of the work station of FIG. 1.

As shown in FIG. 1, two rectangular openings 10*a* and 12*a* are provided in the walls 10 and 12, respectively, and receive video monitors 30*a* and 30*b*, respectively. The monitors 30*a* and 30*b* are mounted for pivotal and reciprocal movement relative to the openings 10*a* and 12*b* as better shown in FIG. 3 in connection with the monitor 30*a*. More particularly, a vertical support assembly 32 mounted within the hollow wall 10 which is not shown in FIG. 3 for the convenience of presentation. The support assembly 32 includes a lower rod 34 resting on a lower frame 36 of the wall 10, and a cylindrical electrical motor 38 mounted over the rod 34 and fastened thereto in any conventional manner. An outer cylinder 40 extends above the motor 38 and receives a telescoping inner rod 42, the upper end of which engages a cap 44 in engagement with the ceiling of the building.

The motor 38 operates in a conventional manner to reciprocate a drive member, or the like (not shown) in an axial direction. The drive member engages the lower end of the cylinder 40 to transmit this reciprocal movement to the cylinder which thus reciprocates relative to the fixed inner rod 42. The cylinder 40 is rotatable relative to the inner rod 42 for reasons to be described.

A cage, or housing, 50 is provided which receives the monitor 30*a* and consists of an upper plate 50*a*, a lower plate 50*b* and a contoured, back wall 50*c*, a portion of which is perforated. Additional support structure, including two end struts 50*d* and 50*e* and a plurality of spaced rods 50*f* extending between the plates 50*a* and 50*b*, support the plates 50*a* and 50*b* and the wall 50*c* in the above manner.

The housing 50 is mounted to the cylinder 40 by collar brackets 52*a* and 52*b* which extend around the cylinder 40 and are connected, in any conventional manner, to the upper and lower plates 50*a* and 50*b*, respectively, of the housing 50. The brackets 52*a* and 52*b* are secured around the cylinder 40 so that they rotate with the cylinder 40 relative to the rod 42, thus enabling the housing 50, and therefore the monitor 30*a*, to be pivoted about the vertical axis of the support assembly 32. As a result, the angular disposition of the monitor 30*a* can be adjusted relative to the wall 10, with the contoured back wall 50*c* permitting this movement over a fairly large angle. Also, actuation of the motor 38 raises or lowers the cylinder 40 and therefore the housing 50 to enable the height of the monitor 30*a* to be adjusted.

A bezel, or trim fitting, 54 extends from each edge of the monitor 30*a* to cover the gap between the monitor and the wall surfaces defining the opening 10*a*. It is noted that the bezel 54 also provides a convenient structure to be gripped by the operator to pivot the housing 50, and therefore the monitor 30*a*, about the support assembly 32 as described above. It is noted that the curved portion 14*e* of the desk module 14 lies in a plane substantially perpendicular to the wall 12 and containing the support assembly 32.

Since a housing identical to the housing 50 supports the monitor 30*b* in the opening 12*a* in an identical manner, it will not be described.

Horizontal raceways 56*a* and 56*b* are mounted in the walls 10 and 12, respectively, at the approximate level of the desk modules 14, 16 and 18 and define compartments for receiving electrical wires, cables, etc., extending from the electrical motor in the pedestal 20, the motor 38, and the monitor 30*a*. The raceways 56*a* and 56*b* have front plates to cover the wires and cables which plates are provided with openings to permit the wires and cables to be inserted into and extend from the raceways. Although not shown in the drawings it is understood that a vertical raceway could be provided in the walls 10 and 12 as needed. A junction box 58 (FIG. 3) is mounted on the raceway 56*a* for facilitating the various electrical connections in a conventional manner. In this context various cutouts can be provided through desk modules 14, 16 and 18 for stringing wires and cables, with examples being shown by the references 14*f* and 14*g* in FIG. 1.

Auxiliary equipment may be mounted on the desk modules 14, 16 and 18. For example a pivoted bracket assembly 60 is mounted, in any conventional manner, to the desk module 14 for supporting an auxiliary monitor, display or the like.

A remote control device 62 is provided which rests on the desk module 14 and is electrically connected to the motor of the pedestal 20 and the motor 38 to raise and lower the desk module 14 and the monitor 30*a*, respectively.

In use, the operator sits at the desk module 14 in a chair, or the like (not shown) generally facing a direction indicated by the arrow A in FIG. 1. The enlarged width portion defined by the curved portions 14*d* and 14*e* provides ample legroom and presents a relatively large surface for writing, operating a keyboard, etc. or for co-workers to conference at the work station. The angular position of the monitor 30*a* can be adjusted as necessary for the viewing comfort of the operator or for group viewing, and the height of the module 14 and the monitor 30*a* can be adjusted by the remote control device 62. Of course, another operator can sit at the module 16 generally facing in a direction indicated by the arrow B in FIG. 1, and the monitor 30*b* can be adjusted in the same manner as discussed above. The corner module 16 can accommodate another operator and another monitor could be provided in the corner defined by the walls 10 and 12 and mounted in the same manner as described above. Alternately, the corner module can be used as a writing surface, for storage, for auxiliary equipment or the like, as necessary.

It is understood that other office components can easily be integrated into the work station of the present invention such as detachable shelves, detachable binders, drawer storage, integrated file storage, printer cards, tables and ergonomic work station platforms.

The work station of the present invention thus has several advantages. For example, it is maximized for ergonomics yet takes up a relatively small amount of space. It provides an adequate, continuous work surface area while still permitting viewing of a computer monitor at an optimum distance. It provides one or more monitors for a plurality of operators while permitting conferencing as needed. The unique curved surfaces of the desk modules minimize space requirements yet provide for adequate work surfaces and leg room. The work station can be arranged in a multitude of configurations and is easily adaptable to different wall arrangements. It gives a finished appearance while eliminating the clutter of wires and cables. It provides for maximum comfort of the operator yet fosters team integration, communication and problem solving.

Figure 4:
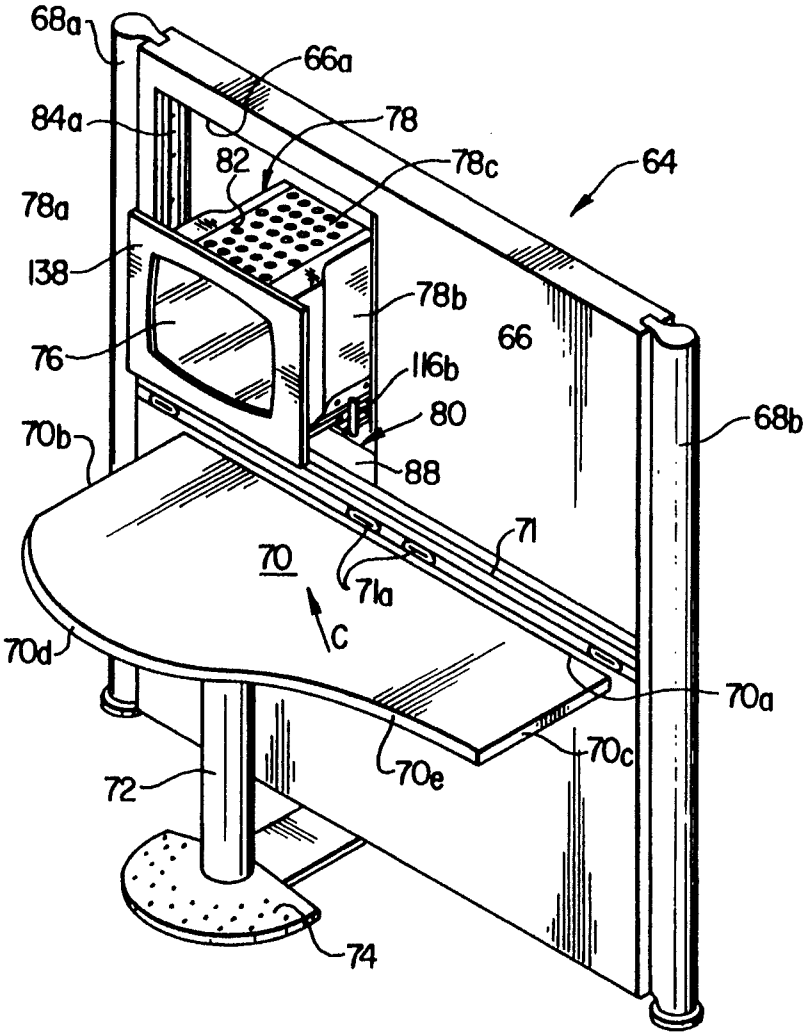
FIG. 4 is a perspective view of an alternative embodiment of the work station of FIG. 1.

Another preferred embodiment of the operator work station of the present invention is shown in FIG. 4 and is referred to in general by reference numeral 64. The work station 64 includes a wall 66 extending from the floor of the building to the ceiling, or to a predetermined height below the height of the ceiling in which case the wall 66 is supported by end supports 68*a* and 68*b*. The wall 66 can be permanently installed or can be "modular", i.e. free standing and quickly assembled and disassembled. In either case the wall 66 is hollow to enable it to contain internal components, as will be described. It is understood that walls similar to the wall 66 can be placed in an end-to-end or perpendicular relationship with the wall 66 to form multiple operator work stations.

The work station 64 includes a work surface, or desk module, 70 extending perpendicular and adjacent to the wall 66. The desk module 70 has a straight side portion 70*a* facing the wall 66 and two straight end portions 70*b* and 70*c* extending perpendicular to the side portion 70*a*. The other side of the module 70 is irregular in shape and is formed by a relatively abruptly curved portion 70*d* extending from the side portion 70*b*, and a relatively gradually curved portion 70*e* extending between the curved portion 70*d* and the other end portion 70*c*. The transition from the abruptly curved portion 70*d* to the gradually curved portion 70*e* occurs approximately midway between the end portions 70*b* and 70*c*. As a result, the desk module 70 is of minimum width near its end portions 70*b* and 70*c* and of maximum width approximately midway between its end portions 70*b* and 70*c*.

The desk module 70 is designed for a left-handed operator who would normally sit adjacent the gradually curved portion 70*e* and face in a direction indicated by the arrow C. This enables the module 70 to be dimensioned so that the operator is located an optimum viewing distance from the monitor (discussed below) yet has ample leg room and writing surface due to the increased module width resulting from the curved portion 70*d*. It is understood that a desk module similar to the module 70 can be designed for a right-handed operator in which case it would be a mirror image of the module 70 (as shown in FIG. 1), and that a plurality of desk modules 70 can be connected in an end-to-end relationship. It is further understood that the desk module 70 could be designed as a "stand-alone" module where the end portions 70*b* and 70*c* could be curved to give the module 70 a finished look.

A horizontal panel 71 is mounted in the wall 66 just above the level of the desk module 70 and includes rubber grommets 71*a* for passing electrical wires, cables, etc., through the wall 66 to or from the module 70. The panel 71 also includes inserts for mounting shelves or other accessories into the wall 66. Although not shown in the drawings, it is understood that additional horizontal or vertical panels similar to the panel 71 could be provided in the wall 66 as needed.

A pedestal 72 extends from the lower surface of the module 70 and supports the module in an elevated position. The pedestal 70 can be fitted with either an electrically or manually actuated device (such as the one shown in FIG. 2) which allows the operator to adjust the height of the module 70 to a desired level. The pedestal 72 extends through a base 74 which rests on the floor, provides support for the pedestal and covers the electrical wire and cables (if any) extending from the pedestal.

As shown in FIG. 4, a rectangular opening 66*a* is provided in the wall 66 and receives a video monitor 76 disposed in a monitor housing, or cage, 78. The monitor 76 and the housing 78 are specially mounted within the opening 66*a* to provide four degrees of freedom to the monitor 76 relative to the opening 66*a*. More particularly, the housing 78 is mounted relative to the wall 66 and the opening 66*a* to allow the monitor 76 to be moved horizontally in and out of the opening 66*a*, vertically up and down within the opening 66*a*, rotationally around a horizontal axis in the plane of the wall 66 and rotationally around a vertical axis in the plane of the wall 66.

The housing 78 consists of two side supports 78*a* and 78*b*, a rectangular upper plate 78*c*, a rectangular lower plate 78*d* (FIG. 6) and a back plate (not shown), the upper, lower and back plates being perforated to provide air cooling for the monitor 76. As shown in FIG. 4, the front portions of the side supports 78*a* and 78*b* include outwardly extending shoulders which define a recess 82, the purpose of which is described below.

Figure 5:
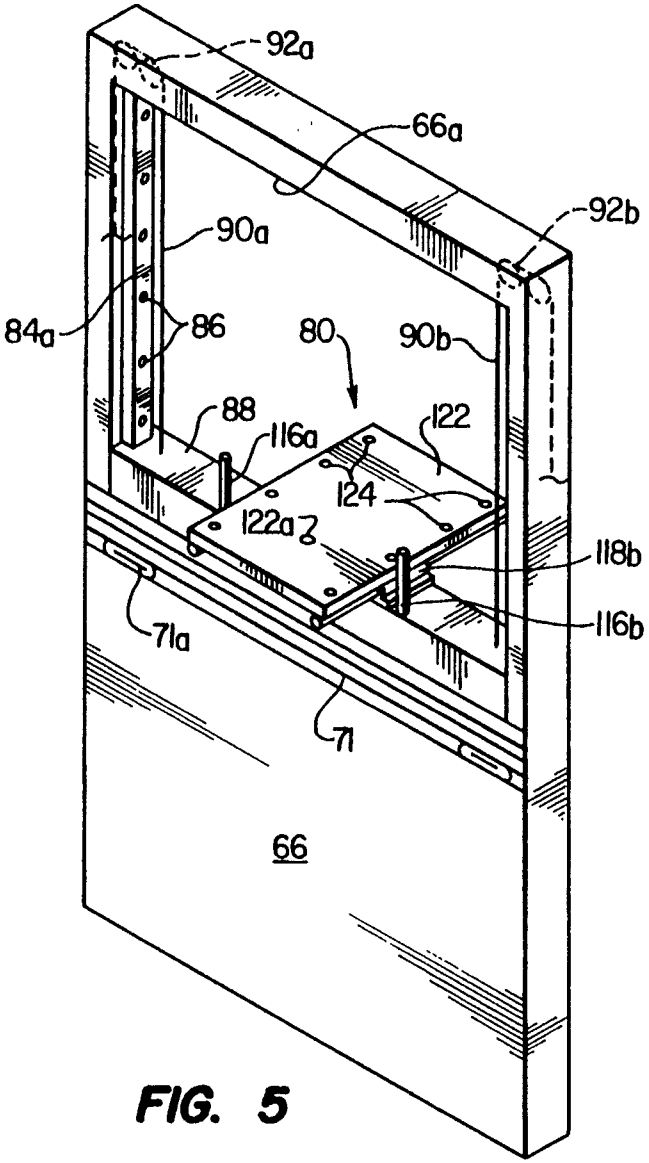
FIG. 5 is an enlarged view of the monitor support assembly of the work station of FIG. 4.
Figure 6:
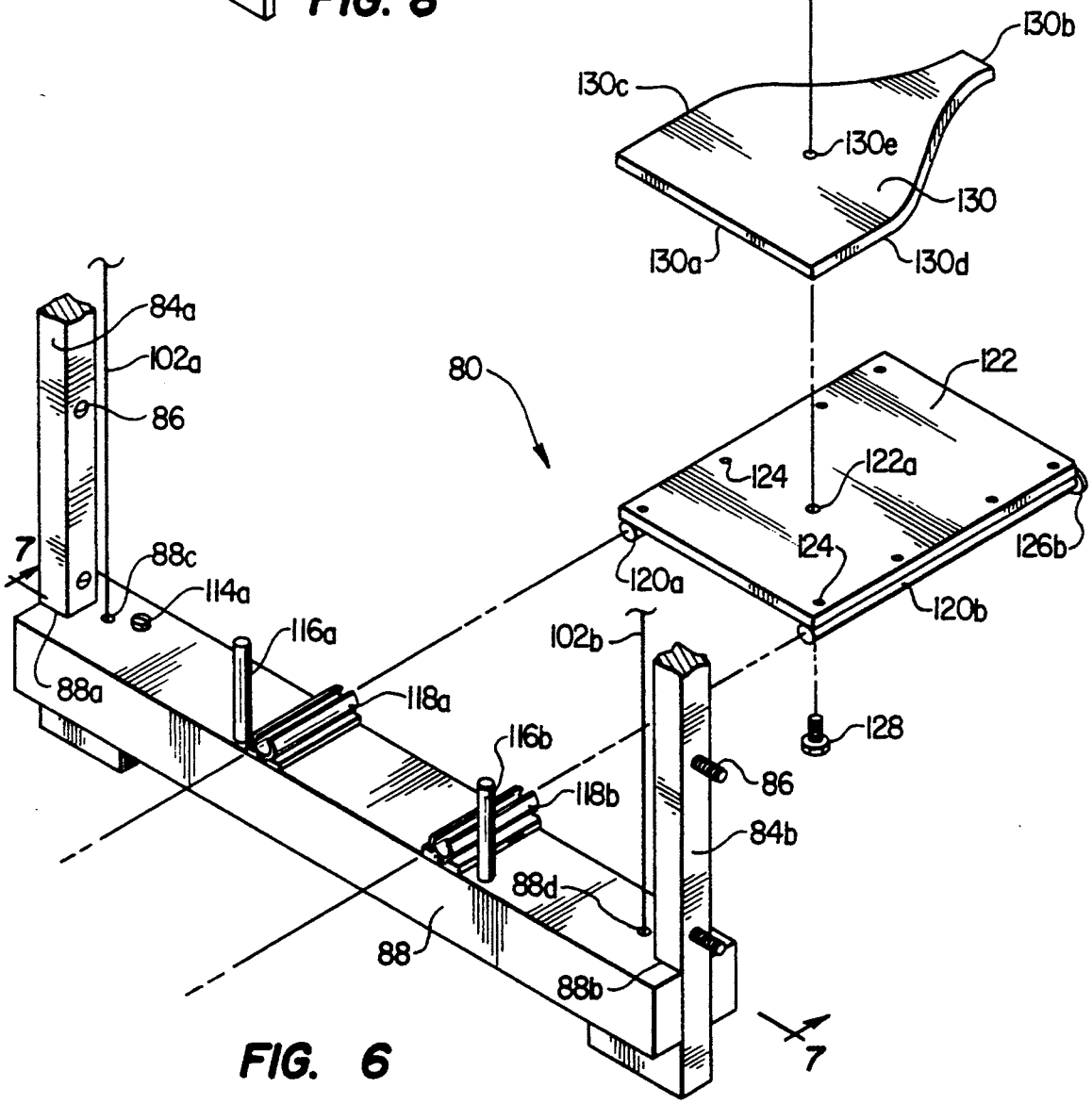
FIG. 6 is an enlarged, partially broken-away view of the monitor support assembly of FIG. 5.

The housing 78, and particularly the lower plate 78*d*, is mounted to a support assembly 80, as shown in FIGS. 5 and 6. The support assembly 80 includes two L-shaped side rails 84*a* and 84*b* fixedly secured within portions of the wall 66 defining the opening 66*a*. The side rails 84*a* and 84*b* may be secured to the wall 66 in any known manner, such as by a plurality of screws, or bolts, 86 as shown in the drawings. Each of the side rails 84*a* and 84*b* extends the height of the opening 66*a* with the lower portion of each being recessed beneath the opening into the wall 66.

A rectangular, hollow support bar 88 engages and is slidably disposed between the side rails 84*a* and 84*b* for vertical movement within the opening 66*a*. More specifically, two groves 88*a* and 88*b* are formed in the respective ends of the bar 88 which receive the side rails 84*a* and 84*b*, respectively, to guide the bar 88 upwardly and downwardly relative to the side rails, as is discussed below.

The bar 88, and those components which it supports including the monitor 76 (as discussed below), are counterbalanced in any known manner to sustain the support assembly 80 in static equilibrium. As an example, and as shown in FIG. 5, wires 90*a* and 90*b* are fixed to the upper face of the bar 88 near its left and right ends, respectively, and extended upwardly in the opening 66*a*. Near the top of the opening 66*a*, the wires 90*a* and 90*b* loop over pulleys 92*a* and 92*b*, after which they travel downwardly within the wall 66 where they are connected to counterweights (not shown).

Figure 7:
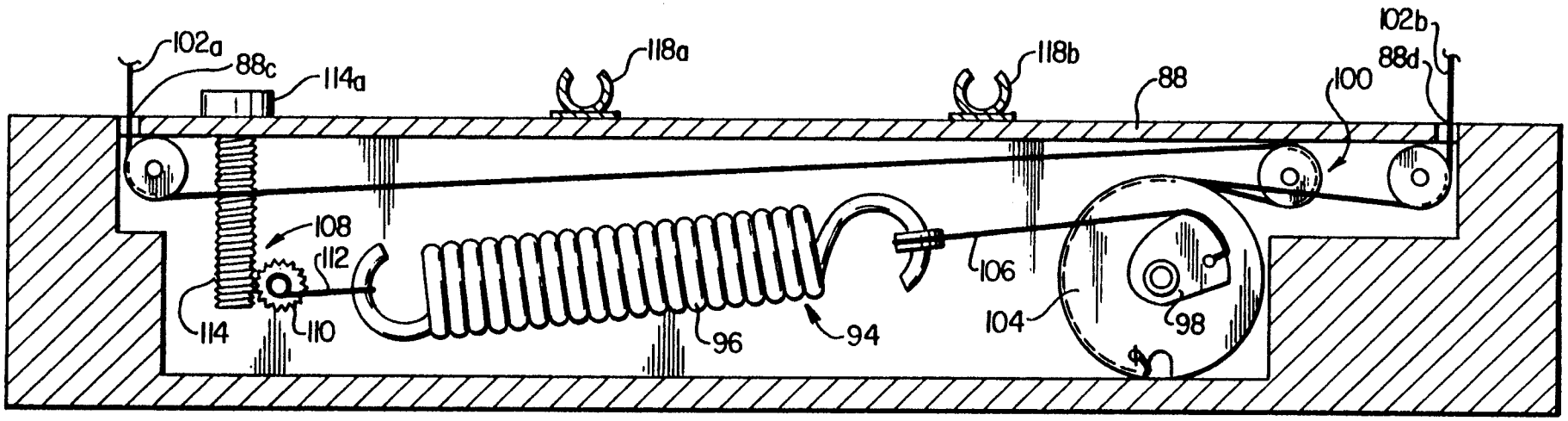
FIG. 7 is an enlarged, cross-sectional view taken along the line 7—7 of FIG. 6.

In a preferred embodiment, the support assembly 80 is counterbalanced by a spring assembly 94 contained within the bar 88 as shown in FIG. 7. The spring assembly 94 essentially consists of a spring 96 maintained in tension by a cam 98 and pulley system 100. More particularly, two wires 102*a* and 102*b* (which correspond to the wires 90*a* and 90*b*) are looped around and fixed to a pulley 104 containing the cam 98. From the pulley 104, the wires 102*a* and 102*b* loop around the pulley system 100 and extend upwardly through holes 88*c* and 88*d*, respectively, in the upper face of the bar 88. The wires 102*a* and 102*b* continue upwardly through the opening 66*a* and are fixed to the wall portion defining its upper end (not shown). A wire 106 connected between the cam 98 and the spring 96 increases tension on the spring 96 as the cam 98 is pulled by the wires 102*a* and 102*b*, such as when the bar 88 is lowered within the opening 66*a*. Conversely, as the bar 88 is raised within the opening 66*a*, the slack created in the wires 102*a* and 102*b* is absorbed by the relaxing of the spring 96. Thus, the support assembly 80 is sustained in static equilibrium.

A worm gearing 108 is provided within the bar 88 to initially adjust the tension in the spring 96 to the necessary level to achieve static equilibrium. The worm gearing consists of a worm wheel, or gear, 110 pivotally secured within the bar 88 and connected to the spring 96 by a wire 112. A worm 114 extending through and engaging a hole in the upper face of the bar 88 meshes with the worm wheel 110 and drives the worm wheel to either increase or reduce the tension in the spring 96, as might be required to initially adjust, or readjust, the spring assembly 94. The worm 114 has a head 114*a* extending above the upper face of the bar 88 for manual engagement.

Referring back to FIGS. 5 and 6, fixed to the upper face of the bar 88 are two vertical guide posts 116*a* and 116*b* extending upwardly therefrom, the purpose for which is described below. Fixed to the upper face of the bar 88 between the posts 116*a* and 116*b* are two spaced, horizontal guides 118*a* and 118*b* aligned perpendicular to the bar 88, each housing a cylindrical roller bearing (not shown) for receiving rods 120*a* and 120*b* attached to a rectangular plate 122.

The rods 120*a* and 120*b* are rigidly secured to the plate 122 in any conventional manner, and in a preferred embodiment are attached to the plate 122 by screws 124. Two stop disks, one of which is shown by the reference numeral 126*b*, are attached to the ends of the rods 120*a* and 120*b*, respectively, which disks engage the guides 118*a* and 118*b*, respectively, when the plate 122 travels from rear to front as shown in FIG. 6 to prevent further movement of the plate 122 and disengagement of the rods 120*a* and 120*b*.

A hole 122*a* is disposed in the plate 122 for receiving a screw 128. Pivotally attached to the plate 122 via the screw 128 is a wishbone-shaped pivot plate 130. The pivot plate 130 has a straight front edge 130*a* and a shorter, straight rear edge 130*b*, both parallel to the bar 88. Connecting the front and rear edges 130*a* and 130*b* are irregular shaped side edges 130*c* and 130*d*, each of which is formed by a relatively straight portion extending perpendicular from the front edge 130*a*, and a curved portion extending from the straight portion to the rear edge 130*b*. As a result, the pivot plate 130 is of maximum width near its front edge 130*a* and of minimum width near its rear edge 130*b*.

The screw engages a hole 130*e* disposed in the pivot plate 130 thereby allowing the pivot plate 130 to rotate relative to the plate 122 around the screw 128. Rotation of the pivot plate 130, however, is limited by the posts 116*a* and 116*b* as they engage the side edges 130*c* and 130*d*, respectively. Due to the curvature of the side edges 130*c* and 130*d*, the degree of rotation afforded the pivot plate 130 is governed by the relative position of the pivot plate 130 to the posts 116*a* and 116*b*, as is described below.

As shown in FIG. 6, the lower plate 78*d* of the housing 78 is pivotally secured to the pivot plate 130, and thus to the plate 122, via the screw 128. The screw 128 engages a hole 132 in the lower plate 78*d* which is aligned with the holes 130*e* and 122*a* of the pivot plate 130 and the plate 122, respectively.

Figure 8:
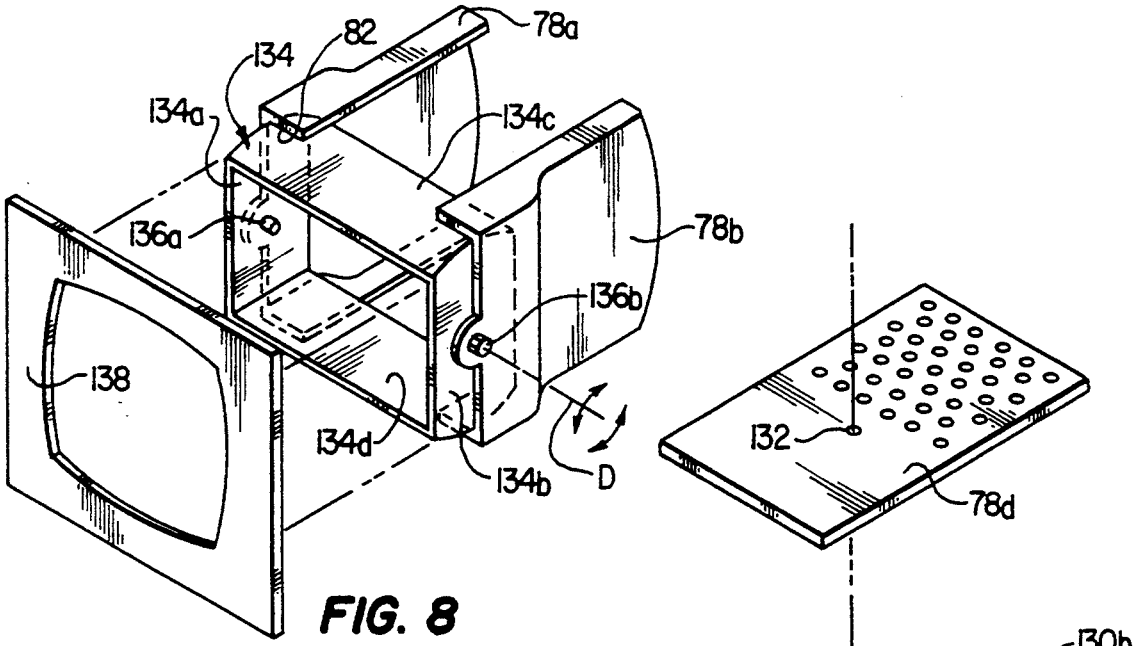
FIG. 8 is an enlarged, partially broken-away view of the monitor of FIG. 4.

Referring now to FIG. 8, a four-sided, generally rectangular shutter 134 is shown for securely engaging the monitor 76 in a conventional manner, the monitor 76 not being shown in the figure for the ease of presentation. The shutter 134 has straight, vertically extending side panels 134*a* and 134*b*, each of which has a hole disposed in its center defining a horizontal line D. Connecting the side panels 134*a* and 134*b* are upper and lower panels 134*c* and 134*d* which are slightly arc-shaped with the line D being their centerline, for reasons described below.

The shutter 134 is secured in the recess 82 defined by the shoulders of the side supports 78*a* and 78*b* of the housing 78 by pins 136*a* and 136*b* that extend from the side panels 134*a* and 134*b* through aligned openings in the side supports 78*a* and 78*b*, respectively. This permits pivotal movement of the shutter 134, and thus the monitor 76, around the line D such that the upper and lower panels 134*c* and 134*d* respectively engage the upper and lower plates 78*c* and 78*d* of the housing 78 in a friction fit. Due to the curvature of the upper and lower panels 134*c* and 134*d*, the shutter 134 can be pivoted about the line D, and thereby tilt the monitor 76 by overcoming the static friction between the upper and lower plates 78*c* and 78*d* and the upper and lower panels 134*c* and 134*d*. Due to the curvature of the upper and lower panels 134*a* and 134*b*, they remain in constant engagement with the upper and lower plates 78*a* and 78*b*.

A bezel, or trim fitting, 138 extends from the front edge of the shutter 134 to partially cover the gap between the monitor 76 and the wall surfaces defining the opening 66*a*. It is noted that the bezel 138 also provides a convenient structure to be gripped by the operator to move the monitor 76 in the four degrees of freedom provided by the support assembly 80 of the present invention.

The alternative operator work station 64 operates in the same manner as the operator work station 8 of the previous embodiment, with the added feature of the operator being able to adjust the position of the monitor with four degrees of freedom. Specifically, the operator sits at the desk module 70 in a chair, or the like (not shown), generally facing a direction indicated by the arrow C in FIG. 4. The enlarged width portion defined by the curved portion 70*d* provides ample legroom and presents a relatively large surface for writing, operating a keyboard, etc. or for co-workers to conference at the work station. The operator can adjust the height of the module 70 to his own likes.

The support assembly 80 of the present embodiment thus allows the operator to adjust the monitor 76 horizontally in and out of the opening 66*a*, vertically up and down within the opening 66*a*, rotationally around a horizontal axis in the plane of the wall 66 and rotationally around a vertical axis in the plane of the wall 66.

The operator can adjust the monitor 76 in any of these directions by simply gripping or pushing the bezel 138 in the desired direction. Specifically, to move the monitor 76 vertically, the operator need only slightly push the bezel 138 either upward or downward to overcome the static friction between the bar 88 and the side rails 84*a* and 84*b* since the weight of the monitor 76 and support assembly 80 is counterbalanced by the counterweights or spring assembly 94. Due to this counterbalance system, the monitor 76 will remain at the height at which the operator disengages the bezel 138.

To move the monitor 76 horizontally in and out of the opening 66*a*, the operator need only push or pull the bezel 138 either toward or away from the wall 66, thereby causing the rods 120*a* and 120*b* of the plate 122 to slide within the guides 118*a* and 118*b*, respectively. The housing 78 is prevented from sliding off of the support assembly 80 and on to the module 70 by the engagement of the stop disks 126*a* and 126*b* against the guides 118*a* and 118*b*. The housing 78 is prevented from sliding rearwardly off of the support assembly 80 by the engagement of the bezel 138 against the wall 66.

To rotate the monitor 76 around its vertical axis, the operator need only push or pull the bezel 138 around such axis, thereby causing the pivot plate 130, and therefore the housing 78, to rotate around the screw 128 relative to the opening 66*a*. The monitor is prevented from striking the portions of the wall 66 defining the opening 66*a* due to the engagement of the side edges 130*c* and 130*d* of the pivot plate 130 with the posts 116*a* and 116*b*, respectively. The side edges 130*c* and 130*d* are shaped to allow the monitor to rotate nearly 90° when the monitor 76 is fully extended horizontally away from the opening 66*a* since in such a position, either the post 116*a* or 166*b* will engage the pivot plate 130 at its minimum width. However, if the monitor 76 is overly rotated such that it would strike the wall 66 as the monitor 76 is pushed back into the opening 66*a*, then either the post 116*a* or the post 116*b* will travel along the side of the pivot plate 130 in engagement therewith, forcing the pivot plate to pivot so that the monitor screen is nearly parallel to the wall 66 as the monitor 76 enters the opening 66*a*.

Finally, to tilt the screen of the monitor 76 up or down, the operator need only push up or pull down on the bezel 138, thereby causing the shutter 134 to rotate relative to the housing 78 and therefore the opening 66*a*. Since the upper and lower panels 134*c* and 134*d* of the shutter 134 remain in constant frictional engagement with the upper and lower plates 78*c* and 78*d* of the housing 78, the tilt orientation of the monitor will remain fixed at the position at which the operator disengages the bezel 138.

Besides having the advantages of the previous embodiment, the operator work station 64 having the support assembly 80 allows an operator to adjust the monitor to its most effective position due to its enhanced adjustability. The operator can bring the monitor closer to him by pulling out from the wall 66 or vice-versa. He can reduce glare on the screen of the monitor by tilting the monitor such that the screen is vertical or tilted slightly downward. He can move the monitor up or down depending on his eyesight level. Further, since all movement of the monitor 76 is done manually, there is less chance that the operator will seriously pinch a finger or some other object between the bezel 138 and the wall 66, as is possible with motor driven actuation.

It is also understood that additional variations may be made in the present invention without departing from the spirit and scope of the invention. For example, any type of viewing screen other than a video monitor can be provided in the housing 50 or 78. Also, the walls can be provided to define a completely enclosed area which may be sound-proofed as necessary, the walls can be partitioned into smaller walls, and additional monitors can be mounted in the walls. Further, the counterbalancing of the support assembly 80 can be accomplished through shock absorbers or other hydraulic system.

Although a preferred embodiment of the present invention has been shown and described, a latitude of modification, change and substitution is intended in the foregoing disclosure, and in certain instances some features of the invention will be employed without a corresponding use of other features. Accordingly, it is appropriate that the appended claims be construed broadly and in a manner consistent with the scope of the invention.

What is claimed is:

1. A work station comprising:

a wall defining a work area;

a work surface module disposed adjacent said wall and defining one or more continuous work surfaces along said wall;

an opening formed through said wall in a predetermined relationship with said work surface module;

means for housing a video monitor; and a support assembly disposed within said opening for mounting said housing means within said opening, said support assembly providing said monitor with at least two degrees of freedom.

2. The work station of claim 1 wherein said support assembly comprises means for enabling said monitor to be raised and lowered parallel to said wall to adjust the vertical position of said monitor relative to said work surface module.

3. The work station of claim 2 wherein said raising and lowering enabling means comprises a horizontal bar slidably disposed in said opening parallel to said wall for vertical movement within said opening.

4. The work station of claim 3 wherein said raising and lowering enabling means further comprises means for counterbalancing the weight of said bar, said housing means and said monitor disposed therein for maintaining said bar in static equilibrium.

5. The work station of claim 4 wherein said raising and lowering enabling means is manually engagable.

6. The work station of claim 3 wherein said support assembly comprises means for enabling said monitor to be moved horizontally toward and away from said wall, said moving means comprising a horizontal plate slidably connected to said bar.

7. The work station of claim 6 wherein said horizontal enabling means further comprises:

horizontal rods rigidly secured to said horizontal plate; and bearing means rigidly secured to said bar for slidably receiving said rods.

8. The work station of claim 7 wherein said horizontal enabling means further comprises means rigidly secured to said rods for halting further forward progress of said horizontal plate.

9. The work station of claim 6 wherein said horizontal enabling means is manually engagable.

10. The work station of claim 6 wherein said support assembly comprises means for enabling said monitor to rotate around a vertical axis, said vertical rotational enabling means comprising a shaped plate pivotally connected between said horizontal plate and said housing means.

11. The work station of claim 10 wherein said shaped plate has a front edge, a rear edge shorter than said front edge, and side edges each formed by a relatively straight portion extending perpendicular from said front edge and a curved portion extending from said straight portion to said rear edge, said vertical rotational enabling means further comprising two vertical posts rigidly secured to and extending upwardly from said bar for engaging said side edges of said shaped plate when said shaped plate is rotated with respect to said wall to limit said rotation.

12. The work station of claim 1 wherein said support assembly comprises means for enabling said monitor to be moved perpendicular to said wall to adjust the horizontal position of said monitor relative to said wall.

13. The work station of claim 1 wherein said support assembly comprises means for enabling said monitor to rotate around a vertical axis to adjust the angular position of said monitor relative to said wall.

14. The work station of claim 13 wherein said vertical rotational enabling means is manually engagable.

15. The work station of claim 1 wherein said support assembly comprises means for enabling said monitor to rotate around a horizontal axis to adjust the tilt of said monitor relative to said wall.

16. The work station of claim 15 wherein said horizontal rotational enabling means comprises a shutter pivotally mounted within said housing means for rotation around a horizontal axis, said shutter having upper and lower arc-shaped panels with said horizontal axis as said arc centerline for engaging said housing means in a friction fit.

17. The work station of claim 15 wherein said horizontal rotational enabling means is manually engagable.

18. A support assembly for mounting a monitor within a housing within an opening of a wall, said assembly comprising:

means slidably disposed within said opening for enabling said monitor to be raised and lowered parallel to said wall to adjust the vertical position of said monitor;

means slidably connected to said raising and lowering enabling means for enabling said monitor to move perpendicular to said wall to adjust the horizontal position of said monitor;

means pivotally connected between said perpendicular enabling means and said housing for enabling said monitor to rotate around a vertical axis to adjust the angular position of said monitor; and means disposed within said housing for enabling said monitor to rotate around a horizontal axis to adjust the tilt of said monitor relative to said surface.

19. The support assembly of claim 18 wherein all of said enabling means are manually engagable.

20. The support assembly of claim 18 wherein said raising and lowering enabling means comprises a horizontal bar slidably disposed in said opening parallel to said wall for vertical movement within said opening.

21. The support assembly of claim 20 wherein said raising and lowering enabling means further comprises means for counterbalancing the weight of said bar, said housing and said monitor disposed therein for maintaining said bar in static equilibrium.

22. The support assembly of claim 20 wherein said perpendicular enabling means comprises:

a horizontal plate;

horizontal rods rigidly secured to said horizontal plate; and bearing means rigidly secured to said bar for slidably receiving said rods.

23. The support assembly of claim 22 wherein said horizontal enabling means further comprises means rigidly secured to said rods for halting further forward progress of said horizontal plate.

24. The support assembly of claim 22 wherein said vertical rotational enabling means comprises:

a shaped plate pivotally connected between said horizontal plate and said housing, said shaped plate having a front edge, a rear edge shorter than said front edge, and side edges each formed by a relatively straight portion extending perpendicular from said front edge and a curved portion extending from said straight portion to said rear edge; and two vertical posts rigidly secured to and extending upwardly from said bar for engaging said side edges of said shaped plate when said shaped plate is rotated with respect to said wall.

25. The support assembly of claim 18 wherein said horizontal rotational enabling means comprises a shutter pivotally mounted within said housing for rotation around a horizontal axis, said shutter having upper and lower arc-shaped panels with said horizontal axis as said arc centerline for engaging said housing in a friction fit.

26. A support assembly for mounting a monitor within a opening in a wall, said assembly comprising:

a housing;

first means disposed within said opening and operatively connected to said housing for permitting translational movement of said monitor in a first plane;

second means disposed within said opening and operatively connected to said housing for permitting translational movement of said monitor in a second plane;

third means disposed within said opening and operatively connected to said housing for permitting rotational movement of said monitor about a first axis; and fourth means disposed within said opening and operatively connected to said housing for permitting rotational of said monitor about a second axis.

27. The support assembly of claim 26 wherein said second plane is perpendicular to said first plane.

28. The support assembly of claim 26 where said second axis is perpendicular to said first axis.

29. The support assembly of claim 26 wherein said first plane is vertical and wherein said first means includes means for compensating for the effects of gravity on said monitor.

30. The support assembly of claim 26 wherein said first axis is in said first plane and said second axis is in said second plane.

31. The support assembly of claim 26 wherein all of said means are manually engagable.

32. The support assembly of claim 26 wherein said first means comprises a horizontal bar slidably disposed in said opening for vertical movement within said opening.

33. The support assembly of claim 32 wherein said first means further comprises means for counterbalancing the weight of said bar, said housing and said monitor disposed therein for maintaining said bar in static equilibrium.

34. The support assembly of claim 32 wherein said second means comprises:

a horizontal plate;

horizontal rods rigidly secured to said horizontal plate; and bearing means rigidly secured to said bar for slidably receiving said rods.

35. The support assembly of claim 34 wherein said second means further comprises means rigidly secured to said rods for halting further forward progress of said horizontal plate.

36. The support assembly of claim 34 wherein said third means comprises:

a shaped plate pivotally connected between said horizontal plate and said housing, said shaped plate having a front edge, a rear edge shorter than said front edge, and side edges each formed by a relatively straight portion extending perpendicular from said front edge and a curved portion extending from said straight portion to said rear edge; and two vertical posts rigidly secured to and extending upwardly from said bar for engaging said side edges of said shaped plate when said shaped plate is rotated with respect to said wall.

37. The support assembly of claim 26 wherein said fourth means comprises a shutter pivotally mounted within said housing for rotation around a horizontal axis, said shutter having upper and lower arc-shaped panels with said horizontal axis as said arc centerline for engaging said housing in a friction fit.

* * * * *